US005361909A

United States Patent [19]

Gemmer

[11] Patent Number: 5,361,909

[45] Date of Patent: Nov. 8, 1994

[54] WASTE AGGREGATE MASS DENSITY SEPARATOR

[76] Inventor: Bradley K. Gemmer, 242 - 52249 Range Road 233, Sherwood Park, Alberta, Canada, T8B 1C7

[21] Appl. No.: 41,400

[22] Filed: Mar. 31, 1993

[51] Int. Cl.[5] ..... B07B 9/00

[52] U.S. Cl. ..... 209/12.1; 209/37; 209/234; 209/672

[58] Field of Search ..... 209/12.1, 21, 30, 31, 209/36, 37, 138, 139.1, 140, 141, 142, 234, 284, 288, 930, 44.1, 672

[56] References Cited

U.S. PATENT DOCUMENTS

| | | | |
|---|---|---|---|
| 532,266 | 1/1895 | Cuplin . | |
| 895,725 | 8/1908 | Clifford . | |
| 3,164,548 | 1/1965 | Rowell et al. . | |
| 4,314,899 | 2/1982 | Styring, Jr. | 209/138 X |
| 4,399,029 | 8/1983 | Clin et al. | 209/234 |
| 4,465,194 | 8/1984 | Coleman | 209/138 X |
| 5,074,992 | 12/1991 | Clinton | 209/12.1 |
| 5,091,077 | 2/1992 | Williams | 209/12.1 |
| 5,137,621 | 8/1992 | Brown | 209/234 |
| 5,205,415 | 4/1993 | Surtees | 209/21 |

FOREIGN PATENT DOCUMENTS

| | | | |
|---|---|---|---|
| 0472242 | 2/1992 | European Pat. Off. | 209/12.1 |
| 605045 | 11/1934 | Germany . | |
| 739193 | 9/1943 | Germany . | |
| 520244 | 8/1976 | U.S.S.R. | 209/36 |
| 700214 | 12/1979 | U.S.S.R. . | |

*Primary Examiner*—D. Glenn Dayoan

*Assistant Examiner*—Tuan N. Nguyen

*Attorney, Agent, or Firm*—Sheridan Ross & McIntosh

[57] ABSTRACT

Apparatus and method are disclosed for separating and recovering the solid particle components of a waste aggregate using screening and air separation mechanisms. Such an aggregate could be log yard waste comprising soil, wood and mineral particles. The aggregate is first mechanically screened to produce a product of fine particles (the soil) and a plurality of sized streams, each comprised of similarly sized particles of different densities (the wood and mineral particles). The sized streams are then separately but simultaneously introduced into an air separation device which comprises an upstanding funnel-like member forming an upwardly converging passage through which air is flowing. The smallest sized stream of particles is fed into the passage at the lowest elevation, where a separation of light and heavier density particles occurs, light particles moving upwards with the air, heavier falling downwards. Medium and larger sized streams are fed at respectively higher elevations, where the air velocities are respectively higher, separation again occurring. The inlet point for each stream entering the converging passage is selected to match the air velocity at that point with the desired separation result: heavier density particles to drop, lighter density particles to rise. Two products are recovered from the funnel-like member, a high density product (the mineral particles) of varying particle size from the base of the passage and a low density product (the wood particles) of varying particle size from the top.

5 Claims, 8 Drawing Sheets

WASTE AGGREGATE MASS DENSITY SEPARATOR

FIELD OF THE INVENTION

This invention relates to apparatus and method for separating solid particles of different density and varying size (for example, the soil, wood and mineral particles of log yard waste) to produce separate products, each having particles of a common density but varying size, using a combination of mechanical size classification and air separation mechanisms.

BACKGROUND OF THE INVENTION

It is a continuing problem in log yards that accumulated log debris becomes mingled with rock and soil, forming an aggregate. Attempts by yard owners to stabilize the wet aggregate to improve traction for equipment results in additional gravel and rock being added.

Decomposition of the wood portion of the aggregate results in the production of noxious by-products that are more frequently being viewed as environmentally unacceptable.

The aggregate is essentially a combination of three particulate components, namely high density mineral particles, low density wood particles, and relatively fine soil particles.

Log yard operators have, to date, sought methods to treat the mixtures, with unsatisfactory results.

Techniques tried have included flotation for separating the wood from the mineral portion, expecting the wood to readily float free. This approach has been unsuccessful due to the large fraction of wood that is waterlogged and will not float. Additionally, the water used for flotation becomes contaminated and becomes a further liability.

Air separation or elutriation techniques have also been attempted in the past. The difficulty with typical elutriation techniques is that they are as likely to lift and separate out small particles of high density rock as they are to separate out larger pieces of low density wood. The product still remains a mixture of mineral and wood particles.

Top soil can be a large fraction of these waste aggregates and is a valuable commodity which has been generally unrecoverable to date.

With the foregoing background in mind, it was the objective of the present invention to provide an apparatus and a method whereby soils and light density material, such as wood, may be successfully separated from higher density material, such as rock, regardless of the variation of sizing in the original aggregate.

SUMMARY OF THE INVENTION

In accordance with the invention, there is provided an apparatus and method for the separation and recovery of the particulate solids components of mixed aggregate, such as log yard aggregate. In a preferred embodiment, the aggregate comprises a fraction of relatively fine particles, a fraction of larger particles having a high density and varying size, another fraction of larger particles having a low density and varying size, and oversize that is to be rejected or otherwise dealt with. The objective is to separate and recover the three fractions separately.

The system apparatus and method, in their preferred embodiment, utilize a combination of sequential mechanical size classification and air separation devices to effect the separation.

The problem to be solved by the system is that the feedstock involves at least two components of different density and the particles of each component vary in size. When considering air separation as a mechanism for separation, it follows that particles of different size require different velocities of air flow to achieve the same desired result, that is upward and downward separation. In a broad form of the invention, therefore, the mixture of particles is first separated or classified into mixture fractions of similar size. Each fraction is then introduced into an air stream moving upwardly through an upstanding duct, preferably of diminishing cross-section, wherein the velocity of the air stream is increasing in an upward direction. The elevation of the point of introduction for each fraction is selected so that the air velocity at that point is adapted to cause the lighter density particles to rise and to enable the heavier density particles to fall. In this way, the desired separation is effected and the problem posed by the varying particle sizes of the feedstock has been solved.

Therefore, in one apparatus aspect, an air separation device for mass density separation is provided for receiving a plurality of "sized streams" at different elevations, each "sized stream" comprising a mixture of particles of components having different densities, said particles having a common narrow size range referred to broadly herein as a "similar" size. The device comprises an upstanding member which forms an upwardly extending passage, preferably of diminishing cross-section, through which air flows at increasing velocity. The air stream is adapted to separate the lighter density particles from the higher density particles in each sized stream, because the solids particles stream is introduced at a pre-determined elevation where the air velocity is appropriate to effect the desired separation. Therefore the device produces a separate light density component product of mixed particle sizes and a separate high density component product of mixed particle sizes.

Preferably, the air separation device comprises:

—a funnel-like member forming an upwardly oriented passage of diminishing cross-section;

—means for inducing air flow upwardly in the passage, whereby increasingly higher velocity air flow is produced in the converging passage;

—said funnel-like member having a plurality of vertically spaced apart inlet means for introducing a corresponding plurality of sized streams to the passage at different elevations;

—said inlet means being arranged to introduce the sized stream having the smallest particles at the lowest elevation (where the passage cross-section is relatively large and the air velocity is relatively low) and the progressively larger sized streams at progressively higher elevations (where the air velocity is higher);

—the location of each inlet means being selected so that the air flow velocity at that elevation is such that the solids particles of different densities, in the sized stream introduced through that inlet means, will separate, with the low density particles rising and the high density particles dropping;

—each said inlet means more preferably comprising air lock means adapted to distribute the incoming sized stream of particles across the lateral area of the passage at that elevation and to impede loss of air through the inlet means;

—said funnel-like member having a first product outlet located at the lower end of the passage beneath the lowest of the inlet means, for removing the high density product of mixed components of varying particle size; and —said funnel-like member having a second product outlet located at the upper end of the passage, beyond the highest of the inlet means, for removing the low density product of mixed components of varying particle size.

Having particular reference to a plurality of sized streams of particulate solids derived from log yard aggregate, said streams having had the soil of the aggregate removed, each such stream comprising a mixture of wood and mineral particles having different densities but similar size, the following steps are involved in the operation of the air separation device:

—Introducing the sized streams into the passage at different elevations, the elevation along the passage for each stream inlet being selected to match the stream particle size range with a particular air stream velocity present at that elevation, which velocity is adapted to cause upward movement of the wood particles and to enable downward movement of the mineral particles;

—So that a product stream of mineral particles of varying size collects at the base of the passage and is removed; and —So that a product stream of wood particles of varying size issues from the upper end of the passage and is removed.

In another apparatus aspect of the invention, a classification apparatus, preferably a mechanical screening device, is provided which is adapted, when fed a particulate aggregate comprising three solids components (such as the soil, wood and mineral of log yard aggregate), to separate and recover the finest fraction (the soil) and to separate the residue (comprising the wood and mineral particles) into the aforementioned sized streams.

More particularly, the mechanical screening device comprises:

—means for classifying particles by size into fractions, said means preferably comprising disc screening means having sequential aligned sizing sections for advancing the aggregate therealong and screening it to separate the particles into progressively larger particle fractions;

—secondary screen means, such as a cylindrical, hollow, rotating trommel, extending along the first section of the disc screen array, for receiving and screening the passed product of the first disc screen section to produce a fine first product (the soil) and a first sized stream; and —a plurality of longitudinally staggered, vertically spaced conveying means, one positioned under each subsequent disc screen section, for receiving the fraction produced by that section and separately conveying it for further treatment.

Again having particular reference to an aggregate comprising soil, wood and mineral particles, such as log yard aggregate, the following steps are involved in the operation of the preferred form of mechanical screening device:

—advancing the aggregate along elongate screening means comprising linearly aligned sections adapted to separate progressively larger sized particle fractions, such as a disc screening array, and screening the aggregate in the first section to pass a first fraction, consisting essentially of fine particulate soil and some associated oversize adapted to pass through the screening means of the section, and to retain a residue aggregate comprising wood particles, mineral particles and oversize;

—delivering the first fraction to a secondary screening means, such as a rotating trommel, and screening it to pass a screened first product consisting essentially of fine particulate soil and retain an oversize product from the secondary screening means (which is the first sized stream);

—separately recovering the first product;

—further advancing the residue aggregate along at least two sequential sections of the screening means and screening the residue aggregate from each preceding section in the next following section to produce from each section a screened sized fraction, consisting essentially of wood and mineral particles having different densities and similar size, and a retained residue aggregate;

—separately collecting each screened sized fraction on a separate conveying means and delivering the fraction to an inlet of the air separation device, said inlets being vertically spaced along the length of the device; and —discarding or otherwise dealing with the residue aggregate from the last section.

In a preferred aspect of the invention, the mechanical screening device and air separation device are sequentially connected so that the sized particle streams from the former device are supplied to the inlets of the latter device to link their previously described processes. As a result, a method for separating the soil, wood and mineral particle components of a particulate aggregate containing oversize is provided, the wood and mineral particles generally being larger than the soil particles, the wood and mineral particles having different densities and varying particulate size, comprising:

(a) screening the aggregate to separate it into a first fraction, comprising soil and oversize, and residue aggregate;

(b) screening the first fraction to separate it into a product consisting essentially of soil and a first sized stream of oversize;

(c) recovering the soil product;

(d) screening the residue aggregate from step (a) to separate it into a second sized-stream and a second residue aggregate, the second sized stream comprising wood and mineral particles having relatively small size;

(e) screening the second residue aggregate to separate it into a third sized stream and a third residue aggregate, the third sized stream comprising wood and mineral particles larger than those of the second sized stream;

(f) recovering the sized streams and introducing each sized stream into an air stream moving upwardly at increasing velocity through a flow passage of diminishing cross-section which is formed by an upstanding funnel-like member, each said stream being introduced at an elevation such that the velocity of the air at that elevation is adapted to cause the wood particles to rise and to enable the mineral particles to fall;

(g) recovering the rising wood particles from the air stream as a product consisting essentially of wood particles of varying size; and (h) recovering the falling mineral products from the air stream as a product consisting essentially of mineral particles of varying size.

More broadly stated, there is provided a method for separating first and second particle components of a particulate solids aggregate, the first component having a lighter density than the second component, the particles of each component having varying size, comprising: classifying the aggregate to separate it into a plurality of sized streams, each stream comprising a mixture of the components with the particles having a similar size; introducing the sized streams simultaneously at different elevations into an air stream moving upwardly with increasing velocity through a flow passage which is formed by an upstanding member, each stream being introduced at an elevation such that the velocity of the air at that elevation is adapted to cause the first component particles of that stream to rise and to enable the second component particles to fall; recovering the rising first component particles from the air stream as a first product consisting essentially of said particles having varying size; and recovering the falling second component particles from the air stream as a second product consisting essentially of said particles having varying size.

DETAILED DESCRIPTION OF THE PREFERRED EMBODIMENT

Figure 1:
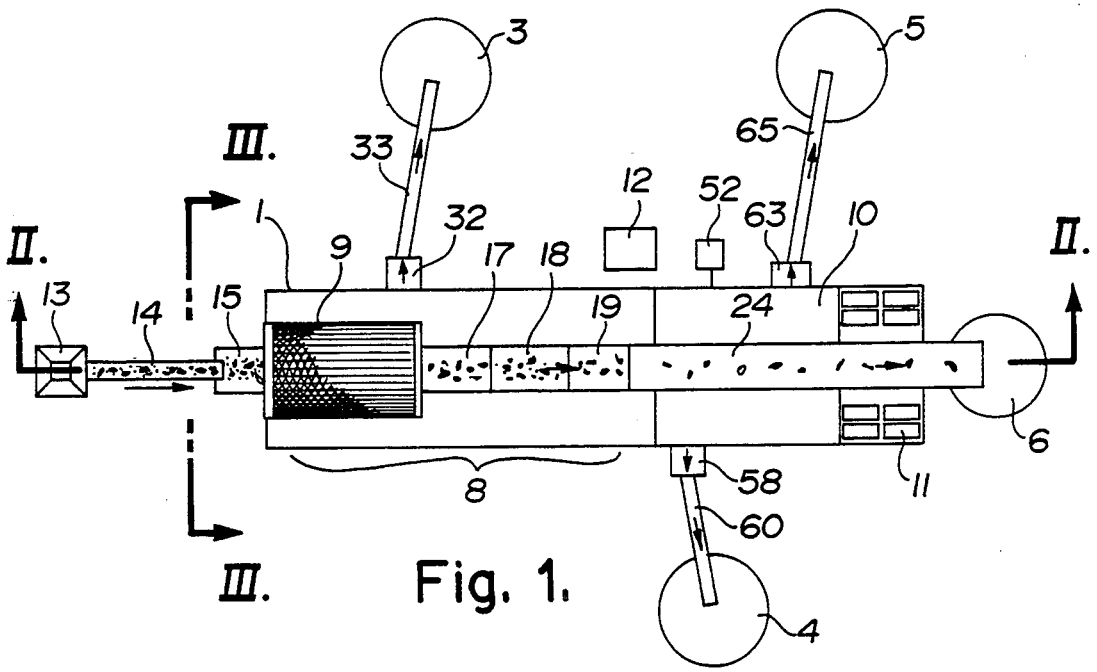
FIG. 1 is a top view of the apparatus.
Figure 2:
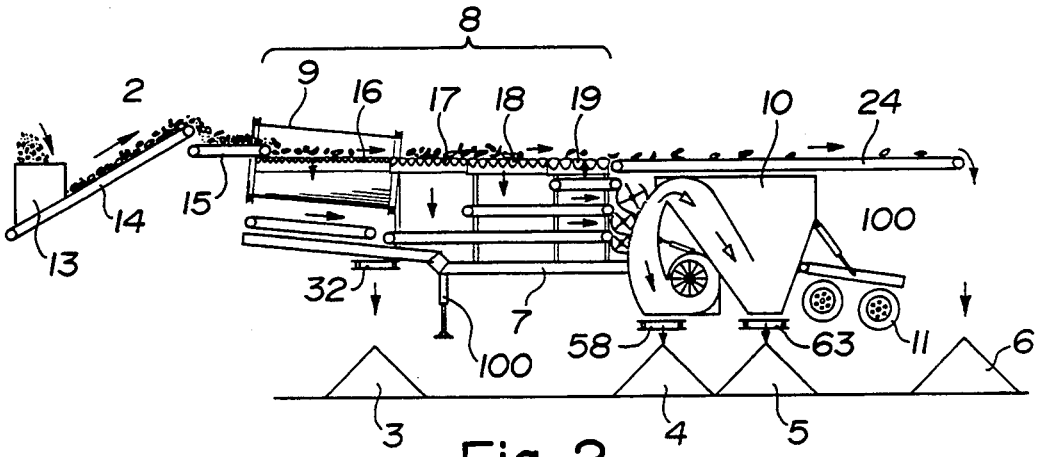
FIG. 2 is a sectional side view of Section A—A according to FIG. 1.
Figure 3:
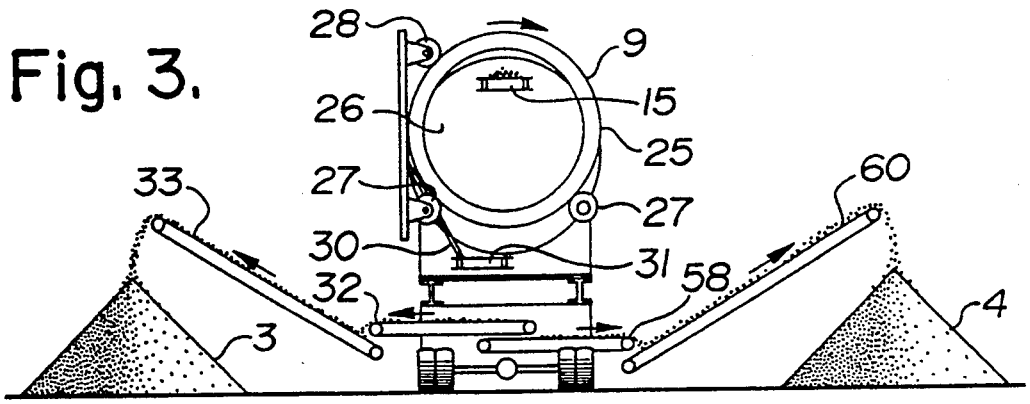
FIG. 3 is a sectional end view of Section B—B according to FIG. 1.

Referring to FIGS. 1 and 2, the invention comprises apparatus adapted as a trailer unit 1, with overall shipping dimensions of about 14 feet high, 55 feet long, and a width of about 8 feet.

The apparatus is adapted to classify particulate feed aggregate 2 composed of material such as soil, wood, and gravel and rocks, typically found at log yards, garbage dumps and recycling facilities. Feed aggregate can vary widely in composition being 70% top soil in one particular instance, 70% wood or 70% rock in others. The apparatus discharges separated streams of fine product 3 like top soil, high density product 4 like metals or rock, low density product 5 like wood, and oversize rejects 6.

The trailer 1 comprises a structural frame 7 for supporting and mounting a disc screening assembly 8, rotary screen or trommel 9, an air separation device 10 and transport rear wheels 11. The trailer configuration is convenient for permitting ease of transport from site to site. A portable generator set 12 is provided to power electric drives and controls. The frame 7 incorporates jacking means 100 near the front and rear for levelling the equipment.

A metered feed hopper 13 and elevating conveyor 14 is used to deliver the aggregate 2 at a nominal 150 cubic yards/hour to the top of the trailer 1. A short, horizontal feed conveyor 15, positioned at the front and top of the trailer 1, directs the aggregate 2 to the disc screening assembly 8.

The disc screening assembly 8 is a horizontal, linearly aligned array of progressively increasing particle sizing sections. Four 4' wide sections 16, 17, 18, 19 are provided, passing particles possessing dimensions of less than 1", 2", 3" and 4" respectively.

Figure 4:
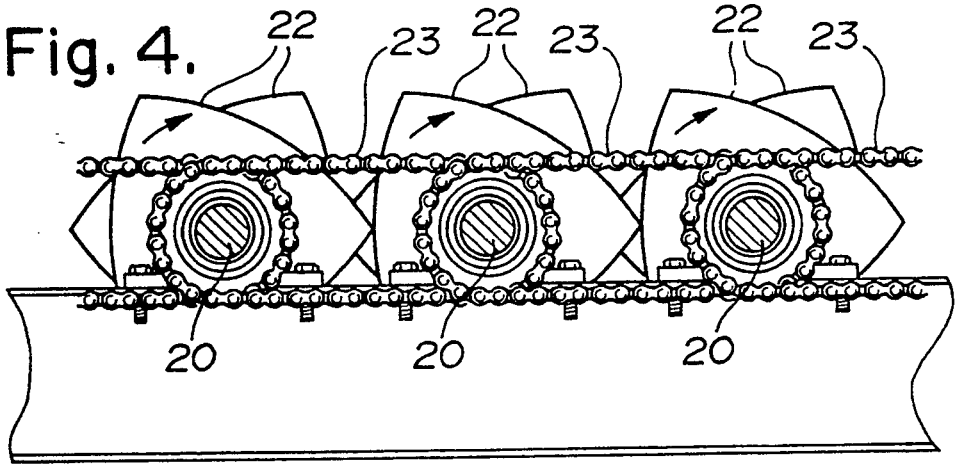
FIG. 4 is a side view of a portion of a disc screening section.
Figure 5:
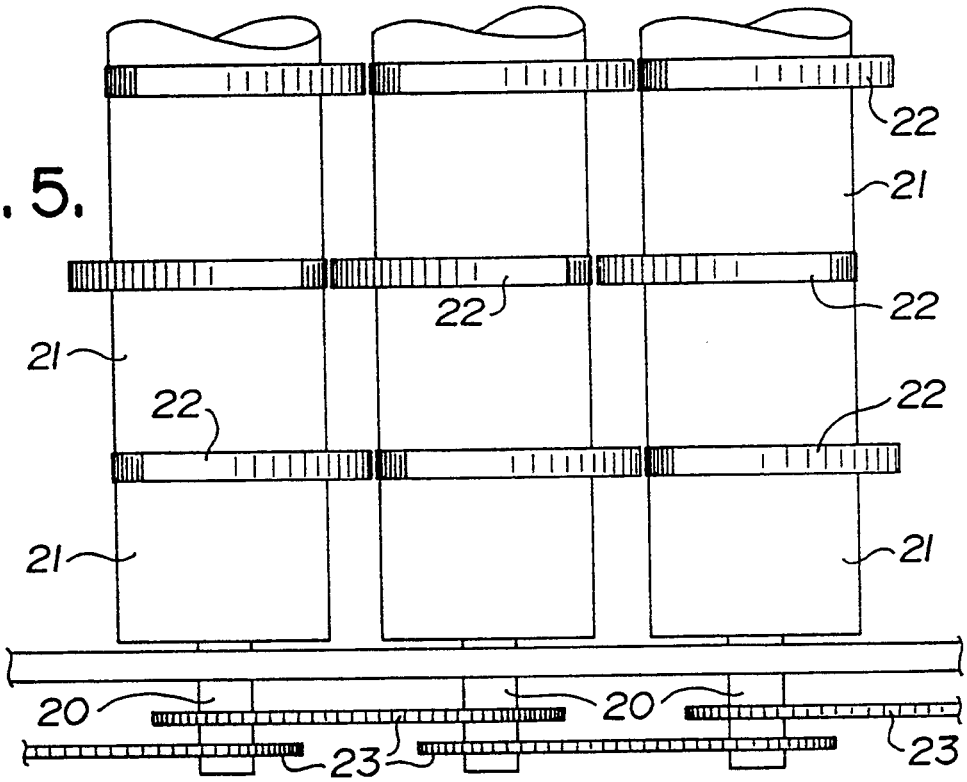
FIG. 5 is a top view of a portion of a disc screening section according to FIG. 4.
Figure 5A:
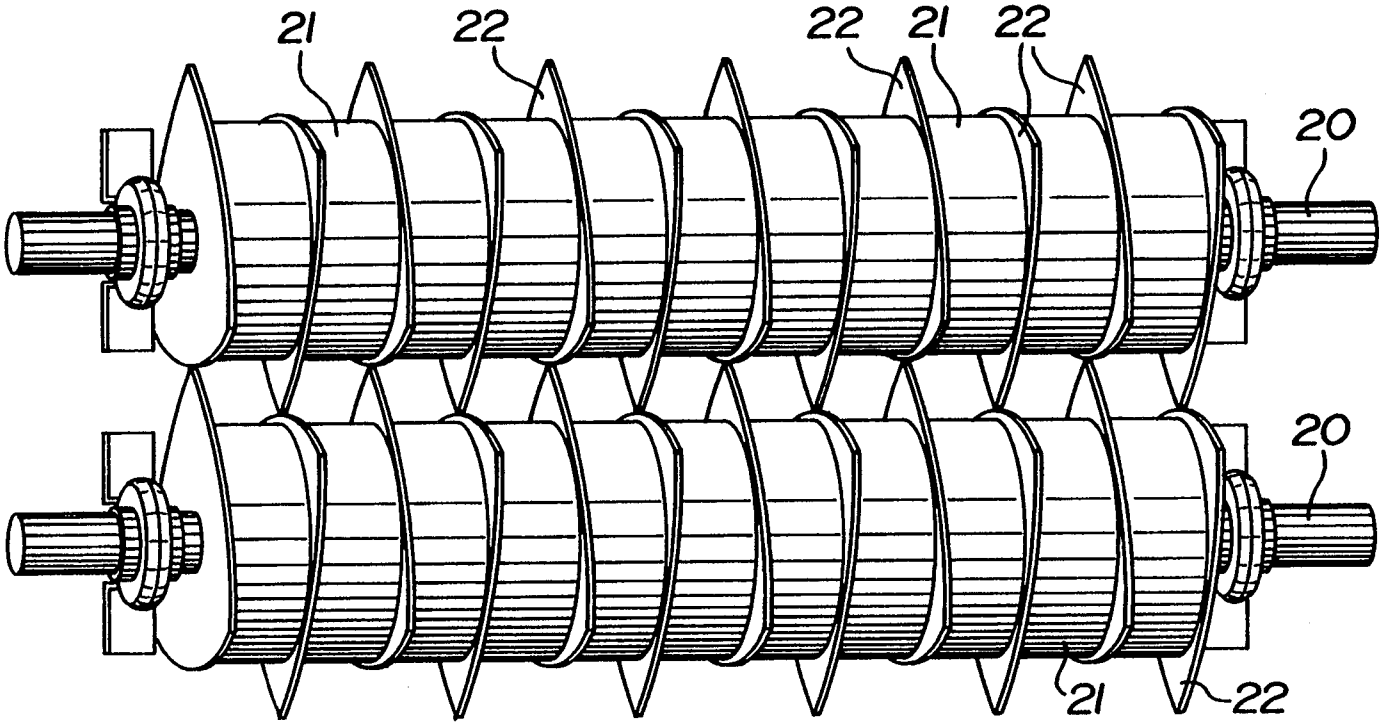
FIG. 5*a* is a perspective top view similar to FIG. 5.

Referring to FIGS. 4, 5, and 5*a* , the disc screening assembly 8 comprises a series of parallel shafts 20, all rotationally driven synchronously. The multiple shafts of the first section 16 rotate at about 250 rpm, and the shafts of the remaining sections 17, 18, 19 rotate at about 120 rpm. A plurality of bushings 21 are installed on each shaft 20. The bushings 21 are of progressively increasing diameter for each section. The spacing between shafts 20 is progressively increased to provide for increasingly larger particle passing sizes. Transverse restrictions on particle passing size are provided by installing triangular cam-shaped discs 22 between the bushings 21 on each shaft 20. The discs 22 are staggered in rotational orientation along the shaft 20, but are synchronized from shaft to shaft providing a constant clearance between successive discs 22 during rotation. The discs 22 provide impetus for advancing oversize to the next screening section. The shafts 20 are driven by a single drive and timing chains 23 cascaded from shaft to shaft.

Figure 6:
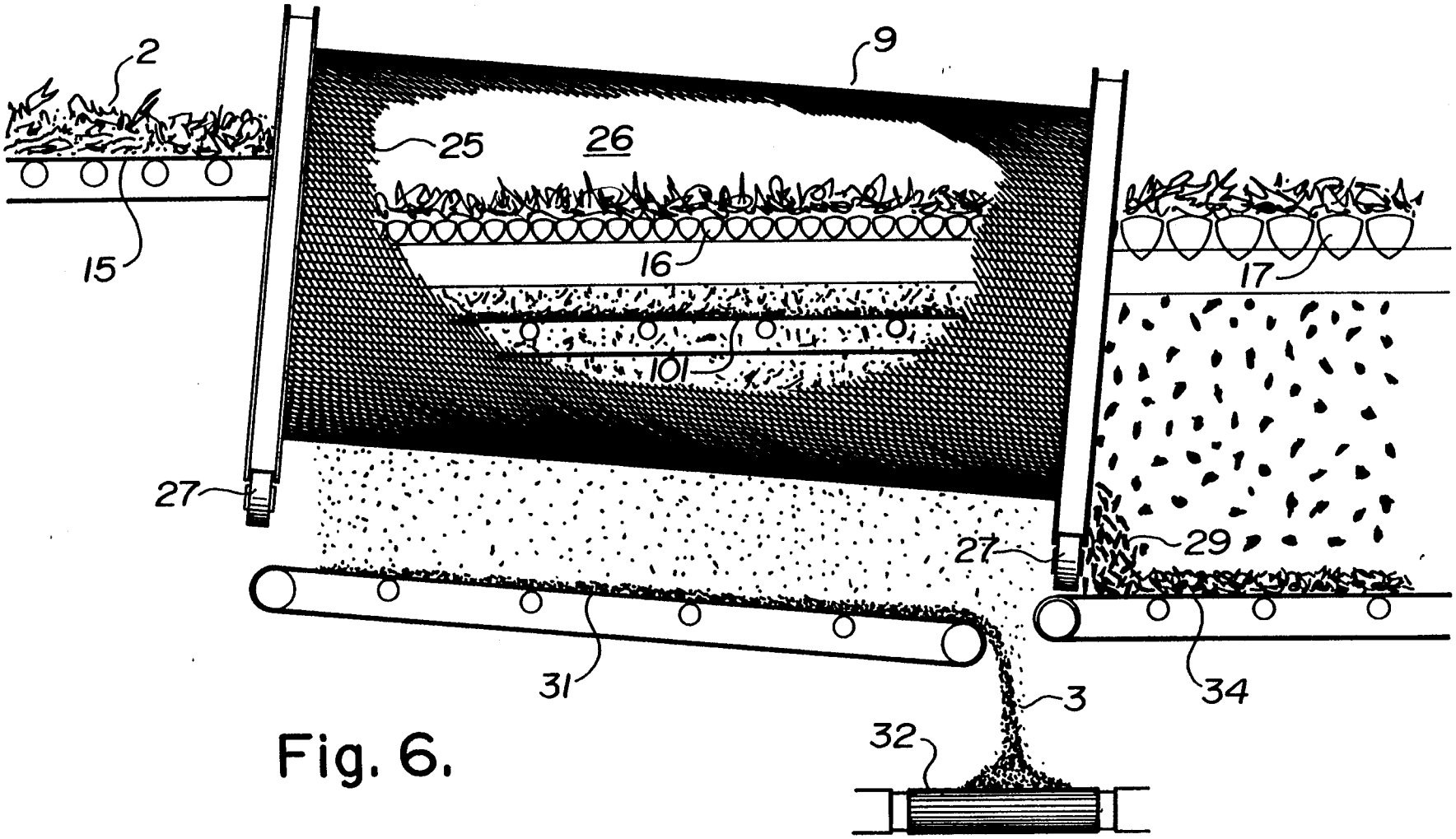
FIG. 6 is a partially cutaway side view of the first disc screening section and trommel, showing particle flows.
Figure 7:
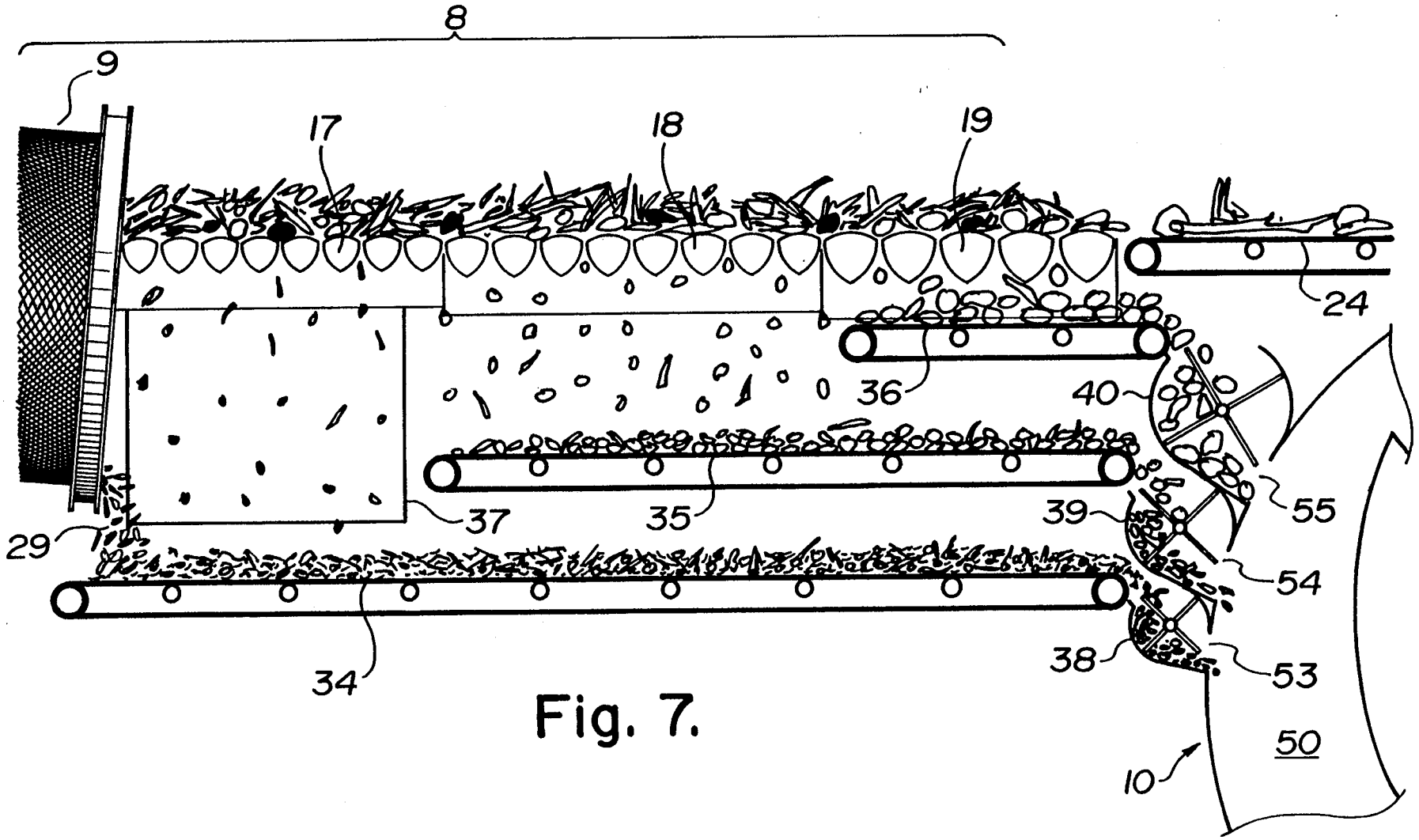
FIG. 7 is a cutaway side view of the second, third and fourth disc screening sections and air locks, showing particle flows.

Referring now to FIGS. 6 and 7, the first 1" disc screen section 16 extends about 12' horizontally and is longitudinally aligned with the trailer 1. The second 9' long, 2" disc screening section 17 is located immediately at the discharge of the first section 16, in aligned formation at the same elevation and accepts oversize material therefrom. The third and fourth disc screen sections 18, 19 follow similarly and are 7' and 6' in length completing an overall 33' long disc screening assembly 8. A rejects belt conveyor 24 is positioned at the end of the disc screening assembly 8 to receive the 4" and larger oversize rejects and to transport them beyond the trailer end for discharge. The rejects conveyor 24 can run at a slow speed and be used for manual sorting.

The trommel 9 is comprised of 1" screen rolled into a six foot diameter drum 25, 12 feet in length, forming a bore 26 inclined at about 5 degrees. The trommel 9 slope is adjustable between about 2 and 10 degrees depending on the required retention time for optimal screening. The trommel 9 rolls at 6 rpm on two pair of outer periphery rollers 27 running at the extreme ends of the drum 25. A pair of side stabilizing rollers 28 act on the upsweep side of the rotation. The trommel 9 extends along and encompasses the first disc screening section 16 within its bore 26 and thus has its drum wall 25 rotating therebelow to capture the finest passing particles and perform a secondary screening step. The rotating action of the trommel and its two dimensional screen openings essentially prevent the passing of long and thin shaped particles that may have two of their three dimensions smaller than the screen size. Two products are produced, one being the commercially valuable 1" -minus top soil-like, graded fine product 3, and a second being 1" trommel oversize 29 that is discharged from the low end of the trommel drum 25.

An intermediate feed-back conveyor 10 1 may be positioned below and parallel to the first disc screening section 16 to intercept the finest passing particles and transport them to the high end or beginning of the trommel 9 to extend its retention time and screening efficiency.

A backing plate 30 is provided on the upsweep side of the trommel rotation to direct screened fines toward a first collecting conveyor 31, located beneath and along the axis of the trommel drum 25. The first collection conveyor 31 receives the fine product and delivers it to a first discharge conveyor 32 located below the end of and transverse to the collection conveyor 31, for transporting the fine product out of the trailer 1 confines and to a fine product stacking conveyor 33 for stockpiling purposes. The first discharge conveyor 32 and fine product stacking conveyor 33 are positioned to the trailer on-site.

The trommel oversize 29 is retained in the apparatus for further processing.

Referring to FIG. 7, a vertically stacked, longitudinally staggered group of three foot wide collection conveyors is aligned below the second, third and fourth disc screen sections 17, 18, 19, for receiving the passed materials therefrom. More particularly, a second collecting conveyor 34 begins at the trommel end and is adapted to receive the trommel oversize 29 and the 2" minus material from the second disc screening section 17. A third, shorter collection conveyor 35 is located above the second collecting conveyor and below the third disc screen 18, to receive the 3" minus material. A fourth, shortest collecting conveyor 36 is located above the third collecting conveyor 35 and below the fourth disc screen conveyor 19 and is adapted to receive the 4" minus material. Side guards 37 are provided to guide passing material from each of the disc screen to each collection conveyor.

The conveyors used in the preferred embodiment are of the endless belt conveyor variety, although other types of conveyor could be substituted.

The second, third and fourth collecting conveyors 34, 35, 36 all terminate at the air separation device 10. The discharges of the conveyors 34, 35, 36 are vertically spaced apart to deliver the smallest particle sizes to the air separation section 10 at the lowest elevation, and the largest particle sizes at the highest elevation.

Each collection conveyor 34, 35, 36 is fitted with an air lock means 38, 39, 40 to discharge its respective material into the air separation device 10. The air separation device 10 contains a moving air mass whose performance would be undesirably affected by air losses through the collection conveyor discharges.

The air locks 38, 39, 40 are constructed in a rotary seal configuration, although other air locks are known and could be substituted. Rubber blades 41 are mounted on a shaft 42, rotatably located within a 4 foot long cylinder 43 which has material entrance 44 and exit 45 portions removed from angular sections of its circumference. The numbers of blades 41 and the two openings 44, 45 are arranged to prevent a gas flow path at any time during the blade rotation. The lower air lock 38 is formed of an 18" diameter pipe, the next higher air lock 39 from a 24" pipe and the highest air lock 40 from a 30" pipe. All three airlock shafts 42 are driven from a single drive means at about 60 rpm.

Figure 8:
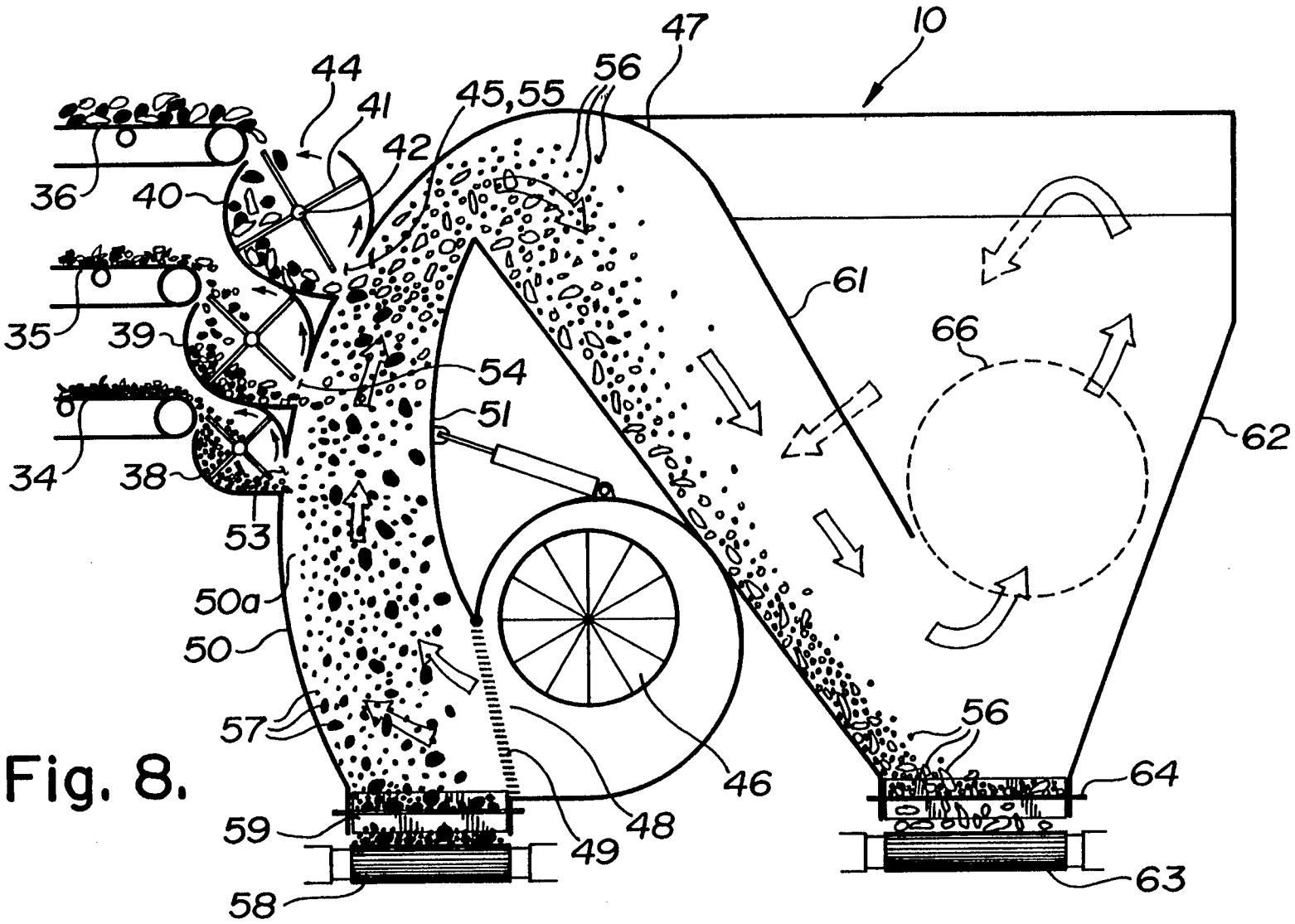
FIG. 8 is a cutaway side view of the air separator device showing particle flows.
Figure 9:
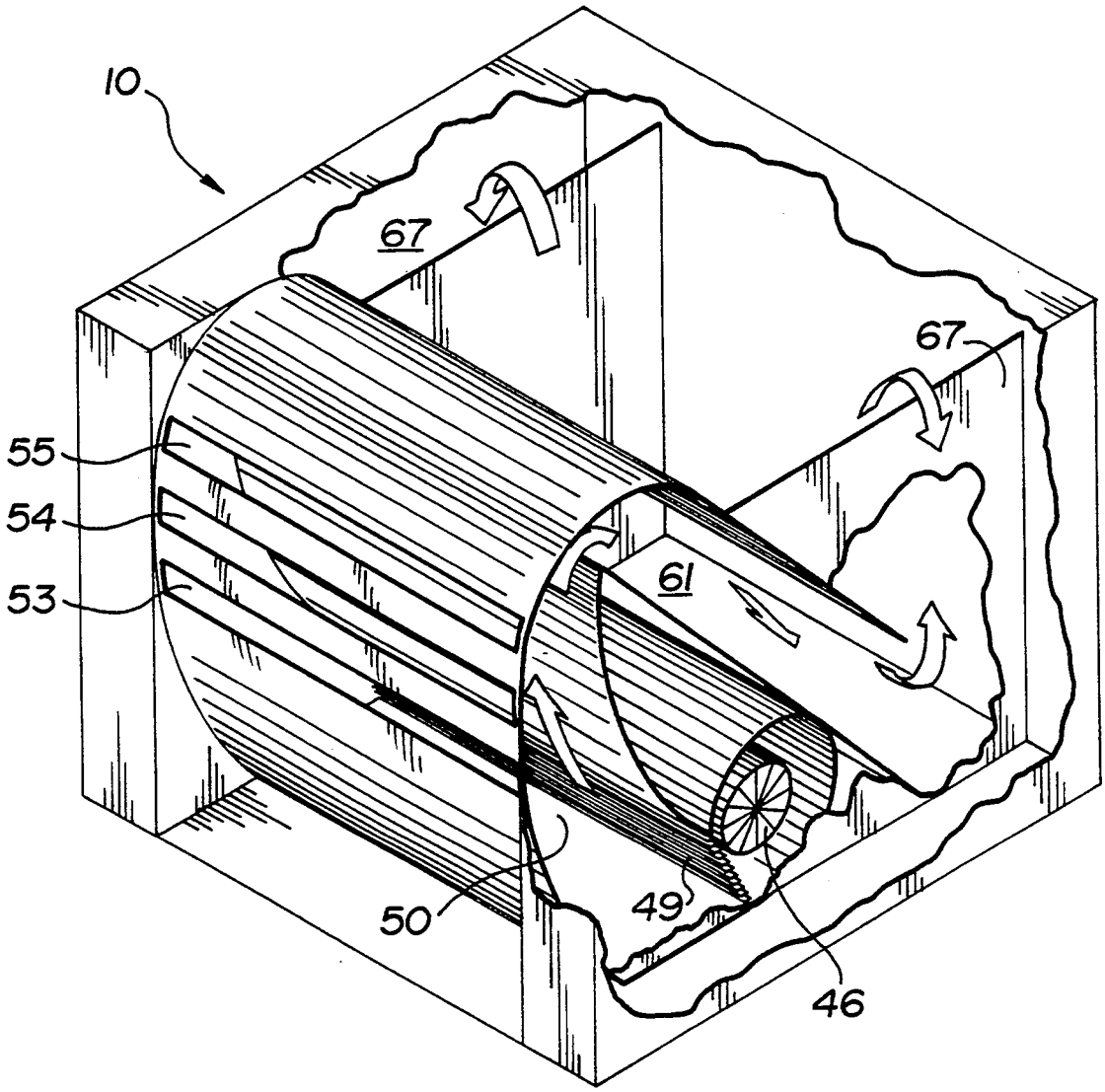
FIG. 9 is a top view of the air separator device showing the air flows.

Referring to FIG. 8, the air separation device 10 comprises a fan 46 and a recirculating air duct system 47. The air duct system 47 provides for the movement of air flows, appropriately contacting a vertically uprising air flow with introduced particles, stripping the lighter density material from the heavier material, collecting separate heavy and light density products and recycling the air back to the fan 46.

The air duct system 47 is comprised of specific sections, each contributing to the separation. A fan outlet 48 guides the air flow through air flow straightening louvres 49 which guides the air into the start of a funnel-like member or separation duct 50. The separation duct 50 takes the form of a substantially vertical passage, through which air is guided upwards. The duct 50 converges upwardly; in other words, it has a diminishing cross-section from the top to the bottom, resulting in an increasing air velocity during the course of rising in the duct 50. An adjustable wall 51 of the duct 50 may be manipulated to adjust the amount of convergence.

The fan 46 produces a nominal 70,000 scfm of air which results in about a 7000 ft/min air velocity at the fan outlet 48. The duct 50 converges upwardly from about 10 square feet in cross-sectional area at the lower airlock 38, to 4 square feet at the upper airlock 40. A fan static pressure head of 9 inches water column is sufficient to overcome pressure drops across the air duct system. The fan 46 may be powered electrically, or as it is a large load, relative to the other drive motors, directly by an engine. The rpm of the fan 46 is adjustable to select the appropriate air flow conditions for a particular feed aggregate 2.

Note that the behaviour of particles in an air stream may be characterized by basic theoretical principles. It is well known to those skilled in the area of particle dynamics that the propensity of a particle to be carried or to "float" in an air flow is a function of its particle density and its size. These characteristics are the basis for determining the particle's terminal velocity, otherwise defined as the highest velocity that a particle may achieve when falling under the influence of gravity in a still air mass. If an air mass is moved upwardly at a particle's terminal velocity, the particle will be falling as fast as it is being carried upwards and it will thus float.

Figure 10:
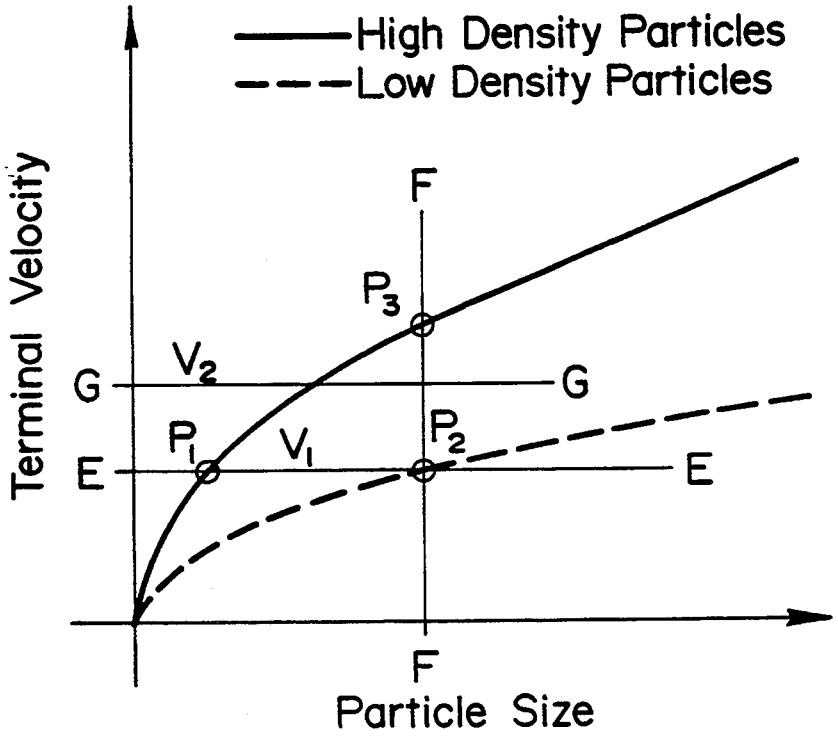
FIG. 10 is a graph of particle terminal velocities as a function of particle size and density.

A characteristic terminal velocity relationship of two particles is shown in FIG. 10, as a function of both differing particle densities and particle size. If one sights along reference line E—E, one can see that when two particles P1 and P2, representing particles of rock and wood respectively, are subjected to an air velocity of V1 (terminal velocity), they will both have the same propensity to float, even though P2 is significantly larger in size than P1. This is possible because P2 is much lighter in density than P1. This demonstrates the difficulty in attempting air separation on particles of mixed sizes.

If, however, one were to sight along line F—F, representing a group of particles of similar size, one can see that rock particle P3, requires a much higher air velocity to achieve float compared to the wood particle P2. When this group F—F, of similarly sized particles, is introduced at an air velocity of V2, represented by line G—G, one can now clearly see that the velocity is too low to support the rock particle P3, and thus it falls, and conversely, the velocity is higher than the terminal velocity of the wood P2 and so it readily floats or is stripped free from the group. If one now provides a plurality of groups of similar sized particles, like those of line F—F, one can see that there are a corresponding plurality of air flow velocities like those of line G—G, which can separate the high density from the low density particles.

With the foregoing in mind, and as depicted in FIG. 8, a plurality of openings 53, 54, 55, for the introduction of sized streams from the air locks, are provided in the sidewall of the duct 50. Smaller particles are introduced at the opening 53 at the lowest elevation and the correspondingly lowest air flow rate. This air flow rate is designed to be in excess of the terminal velocity of the lighter density particles 56 (indicated as unfilled shapes), thereby stripping them from the material flow and lifting them upwards, and is also lower than the terminal velocity of the heavier density particles 57 (indicated as solid filled shapes), allowing them to fall. Preferably, the air locks 38, 39, 40 are designed to distribute the material equally across the duct flow passage 50*a*, to prevent a grouping of many particles from acting as a single large mass.

The cross-section of the duct 50 begins to narrow as the air moves upwards, the air velocity increasing as a result. By the time the next, vertically spaced above opening 54 is reached, the air velocity is high enough to provide separation for the medium sized particles being introduced, lighter density particles 56 being stripped upwards, heavier density particles 57 falling downwards. The previously stripped smaller lighter density particles 56 are being subjected now to velocities much higher than their terminal velocity and continue on upwards. The medium sized, heavier density particles 57 fall downwards through a decreasing air velocity, thus encouraging their propensity to fall.

This arrangement of increasing air velocities and introducing particles of increased size at higher elevations continues until all size fractions have been processed. It is understood that more than three size fractions could be preseparated and treated in the air separation device 10.

The heavier density particles 57 collect at the base of the separation duct 50 which is associated with a second discharge conveyor 58, oriented transverse to the trailer, a pair of rotary air locks 59, each similar to the upper airlock 40 described previously, and a heavy product stacking conveyor 60.

A disengagement duct 61 connects with and follows the separation duct 50. This duct 61 acts to slow and turn the air flow and stripped low density particles 56 downwards. The duct 61 directs the stripped particles 56 to the base of a solids containment hopper 62 at which point the duct opens up to a large cross-section area of about 32 square feet, dropping the air velocity significantly. The duct 61 then turns upwards again, the air flow remaining at low velocity through the upper region of the hopper 62, which is of widening cross-section, further reducing the air velocity.

Essentially all the stripped particles are deposited in the bottom of the hopper 62 as a result of the decreased air velocity and the energy loss in the change of direction, the air flow being unable to continue carrying them.

The stripped, light density particles 56 collect at the base of the hopper 62, which comprises a third discharge conveyor 63, oriented transverse to the trailer, a rotary air lock 64, similar to the upper airlock 40, and a light product stacking conveyor 65.

Referring to FIG. 8, a final rotary screening device 66 is positioned in the hopper 62 to capture any particles which may have escaped the bottom of the hopper and which could build up a recirculating dust load or become a hazard to the fan 46. The low density, de-dusted air flow is returned to the intake of the fan through a duct 67 located outside the hopper 62, disengagement duct 61 and separation duct 50.

It is contemplated that the air stream of increasing velocity can be induced by providing a tubular member having a passage of constant cross-section and introducing a plurality of fan-driven air streams at spaced intervals through vertically spaced air inlets formed in the tubular member sidewall.

It is further contemplated that a vertically spaced and aligned stack of screens could be used to produce the sized fractions of aggregate.

The scope of the invention is defined in the claims now following.

I claim:

1. Mechanical screening apparatus for separating three components of a particular aggregate having a fine first component, second and third components of different density having particles of varying size, and oversize, comprising:

a linear array of disc screening means for classifying particles by size, said means having sequential sizing sections, including a first sizing section, for advancing the aggregate therealong and screening it to separate the particles into progressively larger particle fractions and residue aggregate;

a cylindrical, rotatable trommel, extending along and encompassing the first sizing section, for receiving and screening the fraction passed by said section to produce a first product consisting essentially of the first component and a sized stream of oversize;

a plurality of longitudinally staggered and verticalled spaced conveying means, one positioned under each of the remaining sizing sections, for receiving the fraction produced from that sizing section and conveying it for further treatment.

2. A method for separating first and second particle components of a particulate solids aggregate, the first component having a lighter density than the second component, the particles of each component having varying size, comprising:

classifying the aggregate by advancing it along an array of screens and sequentially screening it to separate it into a plurality of sized streams, each stream comprising a mixture of particles of the components, said particulate having a similar size, the particles of one stream being different in size relative to the particles of another stream;

introducing the sized streams simultaneously at different elevations into an air stream moving upwardly with increasing velocity through a flow passage which is formed by an upstanding member, each stream being introduced at an elevation such that the velocity of the air at that elevation is adapted to cause the first component particles of that stream to rise and to enable the second component particles to fall;

recovering the rising first component particles from the air stream as a first product consisting essentially of said particles having varying size; and recovering the falling second component particles from the air stream as a second product consisting essentially of said particles having varying size.

3. A method for separating first and second particle components of a particulate solids aggregate, the first component having a lighter density than the second component, the particles of each component having varying size, comprising:

screening the aggregate to separate it into a first sized stream and a first residue aggregate, the first sized stream comprising a mixture of the components with the particles having relatively small and similar size;

screening the first residue aggregate to separate it into a second sized stream and a second residue aggregate, the second sized stream comprising a mixture of the components with the particles being similar in size and larger than those of the first sized stream;

separately recovering the first sized stream and introducing it into an air stream moving upwardly at increasing velocity through a flow passage of diminishing cross-section, which is formed by an upstanding funnel-like member, at a first elevation such that the velocity of the air at that elevation is adapted to cause the first component particles to rise and to enable the second component particles to fall;

separately recovering the second sized stream and introducing it to the same air stream at a second elevation higher than the first elevation, so that the velocity of the air at that second elevation is adapted to cause the first component particles to rise and to enable the second component particles to fall;

recovering the rising first component particles from the air stream as a first product consisting essentially of said particles having varying size; and recovering the falling second component particles from the air stream as a second product consisting essentially of said particles having varying size.

4. A method for separating the soil, wood and mineral particle components of a particulate solids aggregate containing oversize, the wood and mineral particles generally being larger than the soil particles, the wood and mineral particles having respectively lighter and heavier densities and varying size, comprising:

(a) screening the aggregate to separate it into a first fraction, comprising soil and oversize, and residue aggregate;

(b) screening the first fraction to separate it into a product consisting essentially of soil and a first sized stream of oversize;

(c) separately recovering the soil product;

(d ) screening the residue aggregate from step (a ) to separate it into a second sized stream and a second residue aggregate, the second sized stream comprising wood and mineral particles having relatively small size;

(e) screening the second residue aggregate to separate it into a third sized stream and a third residue aggregate, the third sized stream comprising wood and mineral particles having particles larger than those of the second sized stream;

(f) recovering the sized streams and introducing each sized stream into an air stream moving upwardly at increasing velocity through a flow passage of diminishing cross-section, which is formed by an upstanding funnel-like member, each stream being introduced at an elevation such that the velocity of the air at that elevation is adapted to cause the wood particles to rise and to enable the mineral particles to fall;

(g) recovering the rising wood particles from the air stream as a product consisting essentially of wood particles of varying size; and (h) recovering the falling mineral products from the air stream as a product consisting essentially of mineral particles of varying size.

5. The method as set forth in claim 4 wherein the aggregate is log yard waste.

* * * * *